United States Patent [19]

Ginzburg

[11] Patent Number: 4,656,859

[45] Date of Patent: Apr. 14, 1987

[54] ROLLING MILL STAND EMPLOYING VARIABLE CROWN ROLLS AND ASSOCIATED METHOD

[75] Inventor: Vladimir B. Ginzburg, Pittsburgh, Pa.

[73] Assignee: Wean United, Inc., Pittsburgh, Pa.

[21] Appl. No.: 767,851

[22] Filed: Aug. 21, 1985

[51] Int. Cl.[4] ..... B21B 27/02; B21B 31/18

[52] U.S. Cl. ..... 72/243; 72/247

[58] Field of Search ..... 72/247, 243, 241, 245

[56] References Cited

U.S. PATENT DOCUMENTS

| | | | |
|---|---|---|---|
| 3,857,268 | 12/1974 | Kajiwaka | 72/247 |
| 3,943,742 | 3/1976 | Kajiwara et al. | 72/247 |
| 4,162,627 | 7/1979 | Shida et al. | 72/247 |
| 4,320,643 | 3/1982 | Yasuda et al. | 72/8 |
| 4,440,012 | 4/1984 | Feldmann et al. | 72/201 |
| 4,519,233 | 5/1985 | Feldmann et al. | 72/247 |

FOREIGN PATENT DOCUMENTS

| | | | |
|---|---|---|---|
| 54-105155 | 3/1981 | Japan . | |
| 0054401 | 3/1984 | Japan | 72/243 |

*Primary Examiner*—Robert L. Spruill
*Assistant Examiner*—Steve Katz
*Attorney, Agent, or Firm*—Arnold B. Silverman

[57] ABSTRACT

A rolling mill stand has a pair of work rolls and a pair of associated backup rolls. The backup rolls are generally cylindrical with portions of varying diameter. The work rolls are generally cylindrical with portions of varying diameter and of different work surface configurations from each other. The work rolls may assume a first position generally aligned with the backup rolls and second and third positions in which the work rolls are axially displaced as a unit in the same direction from the aligned positions with the backup rolls. This permits forming of flat strip, centrally crowned strip, or strip with crowned edges. The work rolls preferably diverge in the same direction and the backup rolls preferably diverge in the opposite direction. A method of achieving a generally flat strip, centrally crowned strip or edge crown strip employing relative axial displacement of work rolls with respect to the backup rolls.

20 Claims, 9 Drawing Figures

ROLLING MILL STAND EMPLOYING VARIABLE CROWN ROLLS AND ASSOCIATED METHOD

BACKGROUND OF THE INVENTION

1. Field Of The Invention

This invention relates to an improved rolling mill stand construction wherein the work rolls and backup rolls are so configurated so as to permit relative axial displacement of the work rolls with respect to the backup rolls to achieve a desired strip crown configuration or a flat strip.

2. Description Of The Prior Art

Various means for achieving the desired profile of strip such as metal strip being processed in a rolling mill have been known. Included within such known systems and procedures has been the production of flat strip, the production of centrally crowned strip, and the production of strip which is relatively thinner in the center than at the crowned edges.

U.S. Pat. No. 4,162,627 discloses a four high mill wherein cylindrical backup rolls are subjected to axial shifting in order to minimize the bending of the work rolls under rolling pressure and to increase the flatness correcting capacity of roll bending U.S. Pat. Nos. 4,440,012 and 4,519,233 disclose the use f non-symmetrical work rolls which are disposed in relative reverse orientation and are adapted for relative axial displacement so as to move from a position of uniform nip to a position of non-uniform nip.

Japanese patent application No. 54-105155 discloses a pair of non-symmetrical rolls which are reversely oriented with respect to each other and adapted for relative axial shifting.

It has been known to provide rolling mill stands wherein the rolls are moved axially in opposed directions. See generally U.S. Pat. Nos. 3,857,268; 3,943,742 and 4,320,643.

In spite of the foregoing disclosures there remains a need for improved apparatus and methods for obtaining desired crown control in the rolling of strip.

SUMMARY OF THE INVENTION

The present invention has met the above-described need. In a preferred embodiment a pair of work rolls cooperates with a pair of backup rolls. The backup rolls are generally cylindrical but have converging and diverging portions. The work rolls have different work roll configurations from each other and are adapted for relative axial movement as a unit with respect to the backup rolls. The work rolls preferably have generally cylindrical portions. In a first axial position, flat strip will be produced. In a second axial position of the work rolls with respect to the backup rolls, centrally crowned strip will be produced and in a third axial position, edge crowned strip will be produced.

By the combination of uniquely configurated cylindrical work rolls and backup rolls as well as the predetermined relative axial positioning, crown control is readily achieved.

The preferred method of the invention involves providing the desired generally cylindrical backup rolls and work rolls with relative axial movement of the work rolls as a unit with respect to the backup rolls being effected to the desired positions so as to accomplish the crown control objective.

It is an object of the present invention to provide apparatus and an associated method for facilitating precise crown control by economical and efficient means.

It is another object of the invention to provide such apparatus and method wherein the relative axial movement of the work rolls permits the path of the strip through the mill to remain the same.

It is another object of the present invention to provide such a mill stand which is compatible with existing rolling mill technology.

It is a further object of the invention to provide such a mill stand which will permit effective thermal crown control and compensation for roll wear.

These and other objects of the invention will be more fully understood from the following description of the invention on reference to the illustrations appended hereto.

DESCRIPTION OF THE PREFERRED EMBODIMENTS

While as will be apparent from the following disclosure the departure from roll cylindrical shape in both the backup rolls and the work rolls will be generally too small to be visually perceptible by the naked eye, the drawings have been created in a manner to emphasize these departures.

Figure 1:
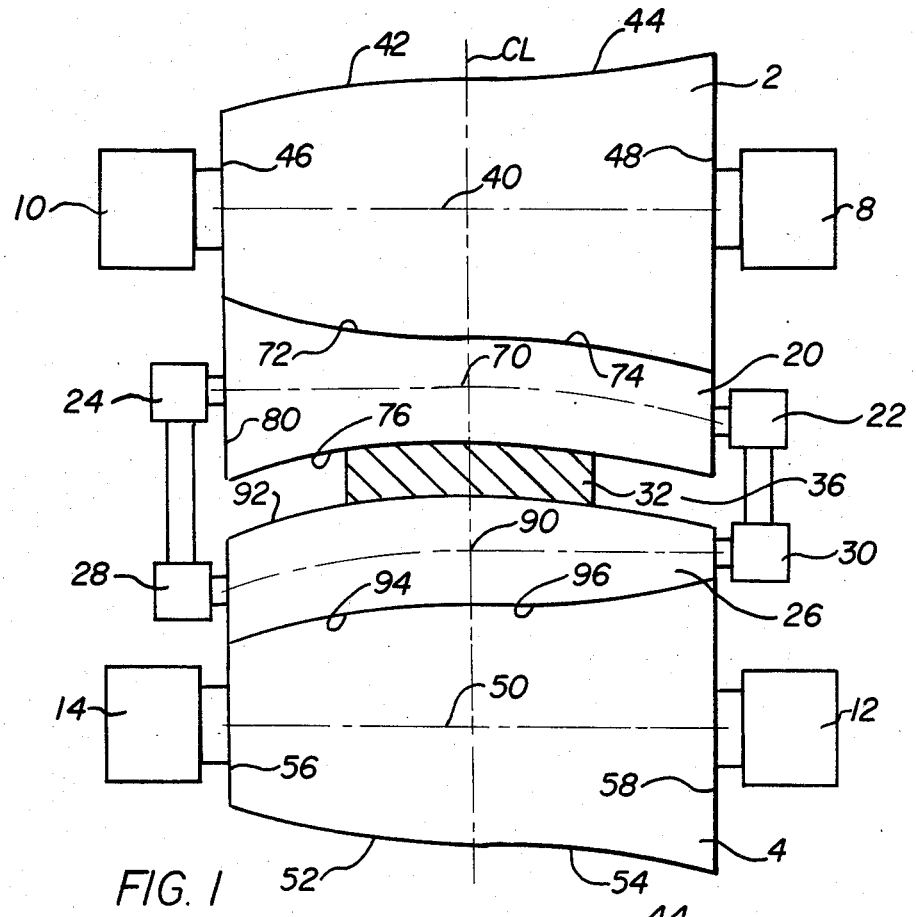
FIG. 1 is a schematic illustration of a form of mill stand of the present invention with the strip positioned to produce a generally flat strip.

Referring now more specifically to FIG. 1, there is shown a four high rolling mill stand for rolling hot or cold metal strip, such as hot band as presently produced in hot strip mills and auto body stock as presently produced in 5 stand cold mills. A pair of generally cylindrical backup rolls 2,4 are suitably journaled for axial rotation, respectively, within chucks 8,10 and 12,14. A pair of work rolls 20,26 which are generally cylindrical but are shown deflected by the rolling load under the influence of backup rolls 2,4 and cooperate with their respective backup rolls are suitably journaled for axial rotation, respectively, within chucks 22,24 and 28,30. Strip 32 is illustrated as passing through the pass opening 36 of the mill stand. The strip 32 is generally flat and will be transversely centered on the mill stand.

Backup roll 2 preferably is generally symmetrical about its longitudinal axis 40. Roll 2 has one axial sector 42 which is outwardly convex and an adjacent axial sector 44 which is outwardly concave. The backup roll 2 diverges generally from end 46 to end 48. The relative dimensions of the work rolls 20,26 and backup rolls 24 allows the work rolls to follow a surface contour of the backup rolls under rolling loads, the latter serving as a very rigid member in comparison with the contacting work rolls.

Backup roll 4 is preferably generally symmetrical about its longitudinal axis 50 and has an axial sector 52 which is outwardly convex and an adjacent outwardly concave sector 54. This roll diverges generally from end 56 to end 58. It is noted that with respect to both backup rolls 2,4, the direction of divergence is the same, i.e. toward the right as viewed in FIG. 1.

Work roll 20 is in contact with backup roll 2 and has a longitudinal axis 70. It has a concave outer surface portion 72 in contact with surface sector 42 of roll 2 and a convex surface portion 74 in contact with concave portion 44 of backup roll 2. The surface portion 76 contacting the strip 32 is generally concave.

Work roll 26 has a longitudinal central axis 90, a concave surface portion 94 in contact with convex portion 52 of roll 4 and a convex surface portion 96 in contact with concave portion 54 of backup roll 4.

Figure 4:
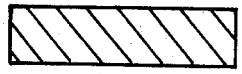
FIG. 4 is a schematic cross-sectional illustration of flat metal strip of the type created by the position shown in FIG. 1.

In the position shown in FIG. 1, flat strip 2 of the desired thickness will emerge from the roll stand as a flat strip as shown in FIG. 4. For convenience of disclosure, this position of the rolls wherein the work rolls 20,26 are generally aligned with the backup rolls 2,4 will be referred to as a first position.

Figure 2:
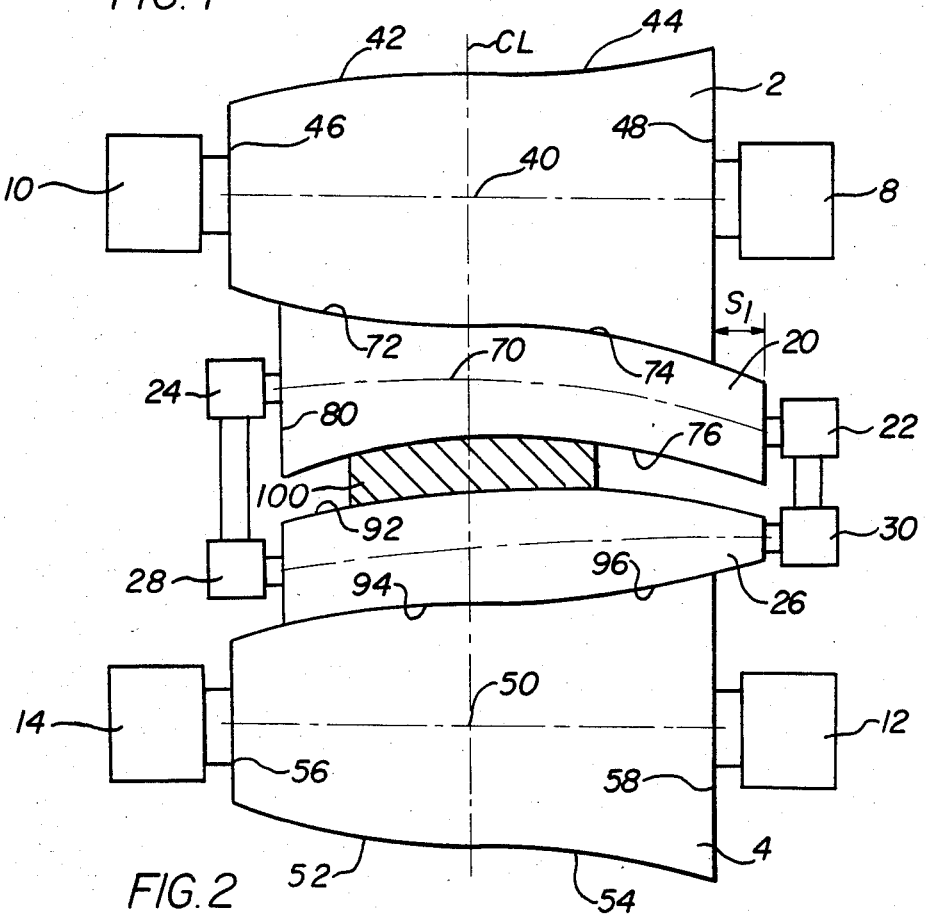
FIG. 2 is similar to FIG. 1, but shows the work rolls axially displaced to a position to produce a centrally crowned strip.
Figure 5:
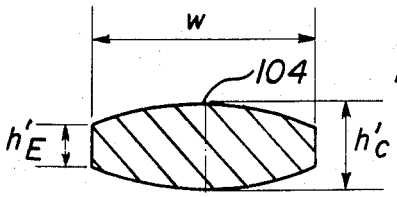
FIG. 5 is a schematic cross-sectional illustration of centrally crowned strip of the type created by the position shown in FIG. 2.

Referring in greater detail to FIGS. 2 and 5, it will be noted that the work rolls 20,26 have shifted axially as a unit to the right as shown in FIG. 2 by a distance $S_1$. The work rolls 20,26 remain in alignment with each other and the work piece designated 100 remains centered along the transverse center line of the backup rolls 2,4. In this position the strip will be provided with a desired central crown 104, as shown in FIG. 5, i.e. the thickness of the strip will be greater at the center than at the edges but otherwise at the desired gauge. As means for effecting axial shifting of work rolls are well known to those skilled in the art and form no part of the invention per se, details of the same need not be disclosed herein. While the preferred embodiment involves movement of the work rolls 20,26 as a unit it will be appreciated that the backup rolls may be moved with respect to the work rolls.

It will be appreciated that by effecting the relative axial movement of the work rolls 20,26 as a unit to the second position shown in FIG. 2, effective creation of a precisely controlled crown is accomplished by employing the same mill stand as was employed to provide a flat strip in the illustration provided in FIG. 1.

As is shown in FIG. 2, both of the work rolls 20,26 diverge in the same direction, i.e. to the left as shown in FIG. 2, which is the opposite direction from the direction of divergence of the backup rolls 2,4. These relative divergences as well as the specific shapes of the four rolls cooperate to provide the crown control of the present invention.

Figure 3:
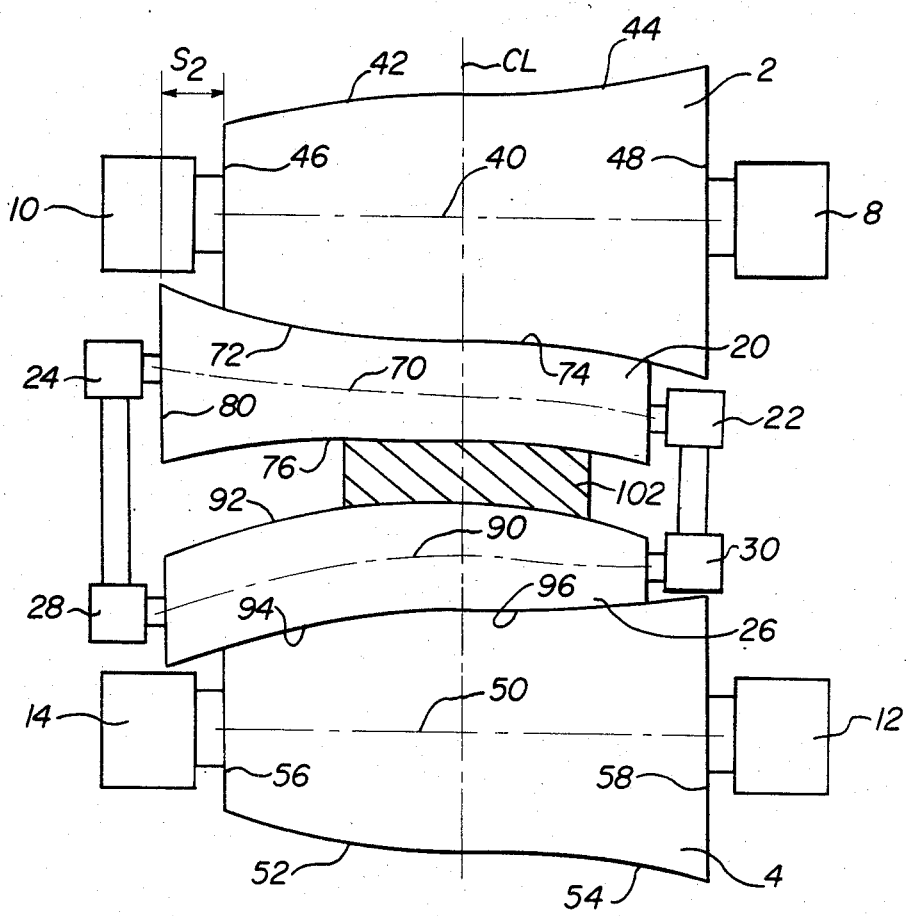
FIG. 3 is similar to FIGS. 1 and 2, but shows the work rolls axially displaced to a position for producing edge crowned strip.
Figure 6:
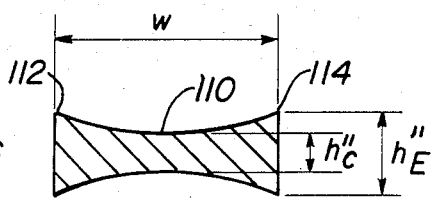
FIG. 6 is a schematic cross-sectional illustration of edge crowned strip of the type created by the position shown in FIG. 3.

Referring to FIGS. 3 and 6, there is shown the apparatus of the present invention with the work rolls 20,26 having been axially displaced relative to the backup rolls 2,4 a distance $S_2$. This position which for convenience of reference will be referred to as the third position involves movement of the work rolls 20,26 as a unit in the opposite direction from the movement effected in achieving the second position. In this position, the work piece 102 remains centered on the center line of the backup rolls 2,4 and a profile having a relatively thinner center 110 and thicker edges 112,114 or a crowned edge will be achieved.

FIGS. 5 and 6 illustrate the central crowned configuration and edge crowned configuration, respectively. The centrally crowned shape of FIG. 5 has a width W, an edge thickness $h'_E$ and a central thickness $h'_c$. The magnitude of central crown c' is determined by the relationship $$c' = h'_c - h'_E.$$

Similarly, in FIG. 6 the edge crown c'' is expressed by the relationship $$c'' = h''_c - h''_E$$

wherein $h''_c$ is the edge crown height and $h''_E$ is the thickness at the center.

In general, it is preferred that distances $S_1$ and $S_2$ each are about two to four inches.

While the relative transverse position of the chucks of the backup rolls and work rolls as one views FIGS. 2 and 3 are illustrated to be offset a substantial amount it will be appreciated that either the lengths of the work rolls may be increased or the mill housings altered to provide the usual housing restraints for the chucks of the work rolls.

In the displacement of the work rolls from the FIG. 1 position to the FIGS. 2 and 3 positions there will be created a asymmetrical loading on the strip. For example, in the FIG. 2 position, the load transferred from the backup rolls to the work rolls is through a longer contact surface on the right side of the mill compared to the left side thereof. This condition will necessitate appropriate determinations of the asymmetrical loading and adjustment in order that the asymmetrical condition will not adversely affect the operation of the mill and particularly its gauge control system, i.e. the control of the roll gap setting when such a system or control is dependent on a rolling load signal.

One way to avoid an incorrect load signal being generated by the offset shifting of the work rolls would be to lengthen the rolls at least an amount equal to the shifting distance involved so that the contact length between the work rolls and backup rolls will always remain the same. A second way would involve compensating for the asymmetrical condition by adjusting the pressure in the work roll balance and/or bending piston cylinder assemblies so that the loading on both sides of the strip would be substantially equal. U.S. Pat. No. 4,320,643 may suggest, in part, as to the correction of the load signal a still different arrangement of compensation which, while addressed to a rolling condition the system is capable of being used in a non rolling condition when shifting the rolls, in which case it would be very similar to present systems for leveling the mill.

Figure 7:
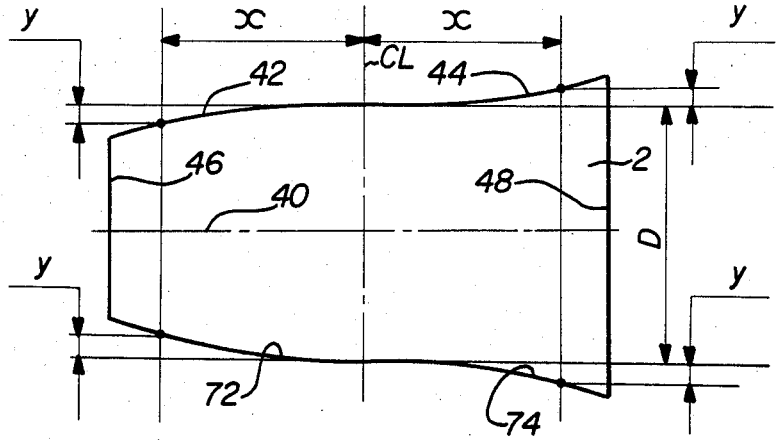
FIG. 7 is a profile of a form of top backup roll of the invention.
Figure 8:
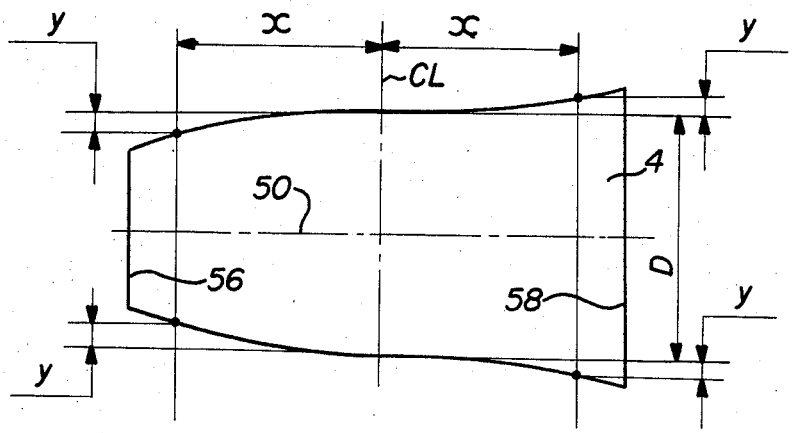
FIG. 8 is a profile of a form of bottom backup roll of the invention.

Referring to FIGS. 7 and 8, there is shown in detail the profiles of backup rolls 2,4. It is noted that any distance x measured from the centerline CL axially the departure of the roll profile from cylindrical shape will be a dimension "y". In one axial direction the periphery converges toward end 46,56 with "y" representing a reduction in diameter from diameter D. In the other axial direction the roll diverges toward end 48,58 and increases in diameter from diameter D by an amount "y". It is preferred for economic reasons that the two backup rolls have substantially identical profiles. The relationship between y and x is preferably such that $$y=f(x)$$

wherein "y" increases smoothly with increases in "x". An example of such a relationship is $$y=a(e^{bx}-1)$$

wherein e is the base of a natural logarithm, constant a=0.003 and b=0.01. The distance "x" is measured from the transverse centerline CL of the rolls. An alternate expression is $$y=ax/(1-bx)$$

wherein e is the base of a natural logarithm, constant a=0.00055 and b=0.025. These constants will remain the same for a given stand.

Figure 9:
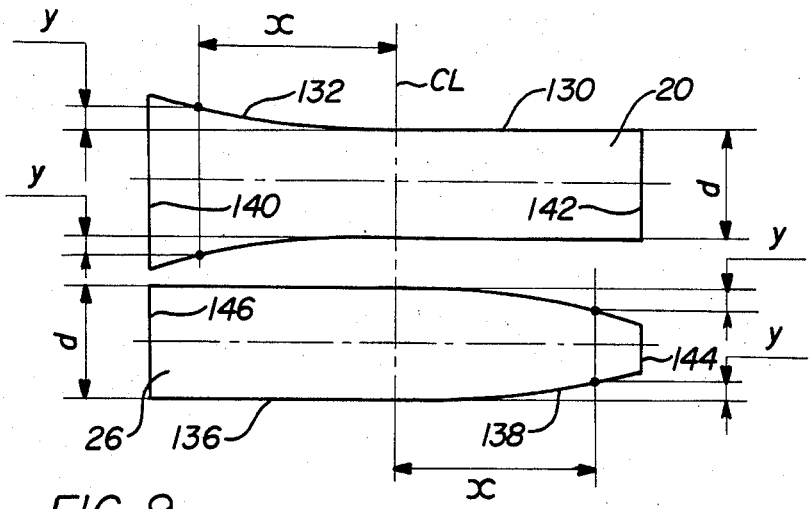
FIG. 9 is a profile of a form of work rolls of the present invention.

FIG. 9 shows the profiles of work rolls 20,26 in their profiles with no load applied. It will be noted that both rolls 20,26 tend to diverge in the same direction, i.e. to the left in FIG. 9. One portion 130,136 of each roll 20,26 is substantially cylindrical. As illustrated at least the portion between the CL and one free end is substantially cylindrical. In work roll 20 the sector 130 between the centerline CL and end 142 and in work roll 26 the sector 136 between the centerline CL and end 146, respectively, are the substantially cylindrical sectors. Sector 130 of roll 20 cooperates with converging sector 138 of roll 26. Sector 136 of roll 26 cooperates with diverging sector 132 of roll 20. The amount of convergence or divergence y at a distance x from the centerline is preferably determined by the relationships disclosed hereinbefore in connection with the backup rolls. The cylindrical portions of the work rolls preferably entered axially at least one half the work roll length.

As is shown in FIGS. 1 through 3, the work rolls 20,26 are deflected under load conditions and are preferably oriented so as to diverge in the same direction as each other but in the opposite direction from the direction of divergence from that of backup rolls 2,4.

EXAMPLE

In order to provide further guidance regarding the invention an example will be considered. A four high mill stand of the present invention may have backup rolls 80 inches long and work rolls in unloaded conditions 86 inches long. The mean diameter of the backup rolls will fall within the range of about 60 to 66 inches and the mean diameter of the work rolls will fall within the range of about 18 to 24 inches. The departure from cylindrical shape (dimension "y") will be about ±10/1000 inch. The strip width is 40 inches. (As was stated hereinbefore the departure from cylindrical shape is sufficiently small as compared with the roll sizes as to not ordinarily be apparent to the naked eye. In order to provide meaningful illustrations of the invention, portions of the drawings have been exaggerated.)

It will be appreciated that selecting the proper relative position of the backup rolls and work rolls consistency of profile from coil to coil is achieved. The mill stand and method compensates for thermal crown buildup and compensation for roll wear which adversely affects the gauge of the strip.

In practicing the method of the present invention using, by way of example, the preferred apparatus as disclosed hereinbefore, one may predetermine the desired flat or crowned strip profile and position the work rolls in the relative axial position with respect to the backup rolls needed to accomplish this objective.

While for convenience of disclosure reference has been made herein to movement of the work rolls with respect to the backup rolls, it will be appreciated that the desired positions may be achieved by relative movement of the backup rolls with respect to the work rolls. Both such concepts shall be embraced by reference to "relative movement" of the work rolls with respect to the backup rolls.

It will be appreciated, therefore, that the present invention provides for the use of uniquely configurated backup rolls which are preferably substantially identical to each other and uniquely configurated work rolls which are different from each other along with the relative axial displacement of the work rolls as a unit with respect to the backup rolls permits the strip to be provided with the desired crown control. All of this is accomplished in a manner which is compatible with existing rolling mill apparatus and methods. Regular spindles may be employed to drive the work rolls, for example.

Whereas particular embodiments of the invention have been described above for purposes of illustration, it will be evident to those skilled in the art that numerous variations of the details may be made without departing from the invention as defined in the appended claims.

I claim:

1. A rolling mill stand comprising a pair of work rolls each having work surfaces and a pair of backup rolls each contacting a said work roll, said backup rolls being generally cylindrical with portions of varying diameter and generally symmetrical about their longitudinal axes, said backup rolls each diverging from a first end toward a second end, both said backup rolls being oriented so as to diverge in generally the same direction, means for positioning said work rolls with respect to said backup rolls in a flat strip producing first position, a central crown strip producing second position or an edge crown strip producing third position, said work rolls having said work surfaces of different shape from each other, said first work roll diverging toward one end thereof, said first work roll diverging in a direction generally opposite to the direction of divergence of said backup rolls, said second work roll diverging toward one end thereof, said second work roll diverging in the same general direction as said first work roll diverges, and means for axially displacing said work rolls with respect to said backup rolls in the same direction in moving said work rolls from one said position to another said position.

2. The rolling mill stand of claim 1 including means for deflecting a first said work roll to establish a generally concave work surface configuration, and means for deflecting a second said work roll to establish a generally convex work surface.

3. The rolling mill stand of claim 2 including an axial portion of said backup rolls being generally convex, and an axial portion of said backup rolls being generally concave.

4. The rolling mill stand of claim 3 including said backup rolls diverging from a first end adjacent said convex portions toward a second end adjacent said concave portions.

5. The rolling mill stand of claim 4 including said work rolls being substantially aligned with each other regardless of which of said three positions of said work rolls are in with respect to the position of said backup rolls.

6. The rolling mill stand of claim 5 including said second position is disposed in the opposite axial direction with respect to said first position from said third position.

7. The rolling mill stand of claim 6 wherein said first position being about two to four inches from said second position, and said first position being about two to four inches from said third position.

8. The rolling mill stand of claim 6 including said stand being a four high mill stand.

9. The rolling mill stand of claim 1 including an x axis extending along the longitudinal axis of each said backup roll and a y axis oriented generally perpendicular thereto, and the departures from cylindrical roll shape of the backup rolls having the relationship $$y=f(x)$$

wherein y increases smoothly with increases in x.

10. The rolling mill stand of claim 9 including the departures from cylindrical roll shape of the work rolls satify the same said relationship.

11. The rolling mill stand of claim 9 including each said backup roll having reductions in diameter with respect to cylindrical portions on one side of the backup roll centerline, and each said backup roll having increases in diameter with respect to cylindrical portions on the other side of the backup roll centerline.

12. The rolling mill stand of claim 1 including a first said work roll having a cylindrical portion and a portion of increased diameter with respect to said cylindrical portion, and a second said work roll having a cylindrical portion and a portion of reduced diameter with respect to said cylindrical portion.

13. The rolling mill stand of claim 17 including said cylindrical portion of said first work roll contacting said reduced diameter portion of said second work roll, and said cylindrical portion of said second roll contacting said increased diameter portion of said first work roll.

14. The rolling mill stand of claim 13 including said work roll cylindrical portions extending axially at least one half the length of said work roll.

15. A method of rolling mill strip crown control comprising providing a pair of work rolls which are generally cylindrical with portions of varying diameter and of different work surface configurations from each other, providing a first said work roll with a cylindrical portion and a portion which has an enlarged diameter with respect to said cylindrical portion, providing a second said work roll with a cylindrical portion and a portion which has a reduced diameter with respect to said cylindrical portion, positioning said first work roll cylindrical portion adjacent to said second work roll reduced diameter portion and said second work roll cylindrical portion adjacent to said first work roll enlarged diameter portion, providing a pair of backup rolls with each said backup roll being operatively associated with a said work roll and said backup rolls being generally cylindrical with portions of varying diameter, providing said backup rolls with substantially identical profiles which diverge generally from one end to the other end, and positioning said backup rolls with the direction of divergence being the same for both rolls.

providing said strip with either a substantially flat, centrally crowned or edge crowned configuration by axially positioning said work rolls as a unit relative to said backup rolls in order to provide predetermined forces to the strip.

16. The method of claim 15 including providing a flat strip by maintaining said work rolls in generally aligned relationship with said backup rolls.

17. The method of claim 15 including providing a centrally crowned strip by relatively axially displacing said work rolls with respect to said backup rolls in a first axial direction.

18. The method of claim 15 including providing an edge crowned strip by axially displacing said work rolls as a unit in a direction which is opposite from the axial direction which would be employed when a centrally crowned strip is desired.

19. The method of claim 15 including providing said work rolls which have one end larger than the other, positioning said work rolls with the axial direction from the smaller roll ends to the larger roll ends being opposite to the direction of divergence of said backup rolls.

20. The method of claim 19 including an x axis extending along the longitudinal axis of each said backup roll and a y axis oriented generally perpendicular thereto, establishing the departures from cylindrical shape in all said rolls within said stand by a relationship $$y=f(x)$$

wherein y increases smoothly with increases in x.

* * * * *

UNITED STATES PATENT AND TRADEMARK OFFICE

CERTIFICATE OF CORRECTION

PATENT NO. : 4,656,859

DATED : April 14, 1987

INVENTOR(S) : VLADIMIR B. GINZBURG

It is certified that error appears in the above-identified patent and that said Letters Patent is hereby corrected as shown below:

ON THE TITLE PAGE:

The Assignee should be "United Engineering Rolling Mills, Inc. and International Rolling Mill Consultants, Inc."

Signed and Sealed this

Fourteenth Day of March, 1989

*Attest:*

DONALD J. QUIGG

*Attesting Officer*

*Commissioner of Patents and Trademarks*